United States Patent [19]

Upton

[11] 4,347,939

[45] Sep. 7, 1982

[54] THERMOFORMED CLOSURE OF COMPOSITE MATERIAL

[76] Inventor: John D. Upton, 76 Clapboard Hill Rd., Green's Farms, Conn. 06436

[21] Appl. No.: 726,223

[22] Filed: Sep. 24, 1976

[51] Int. Cl.[3] ..... B65D 41/34

[52] U.S. Cl. ..... 215/252; 215/341

[58] Field of Search ..... 215/252, 318, 330, 334, 215/341, 346, 348; 264/45.5, 45.6

[56] References Cited

U.S. PATENT DOCUMENTS

| | | | |
|---|---|---|---|
| 2,423,582 | 7/1947 | Coleman | 215/252 |
| 2,990,078 | 6/1961 | Fields | 215/252 |
| 3,262,625 | 7/1966 | Russell | 264/45.6 X |
| 3,270,904 | 9/1966 | Foster | 215/318 |
| 3,310,191 | 3/1967 | Kern | 215/252 |
| 3,866,845 | 2/1975 | Keeler | 215/341 |

*Primary Examiner*—Donald F. Norton
*Attorney, Agent, or Firm*—Darby & Darby

[57] ABSTRACT

An improved container closure which is thermoformed from a sheet of two thermoplastic materials, where one of the materials, which constitutes the inner liner of the closure, is an expanded cellular plastic foam.

3 Claims, 7 Drawing Figures

FIG. 6
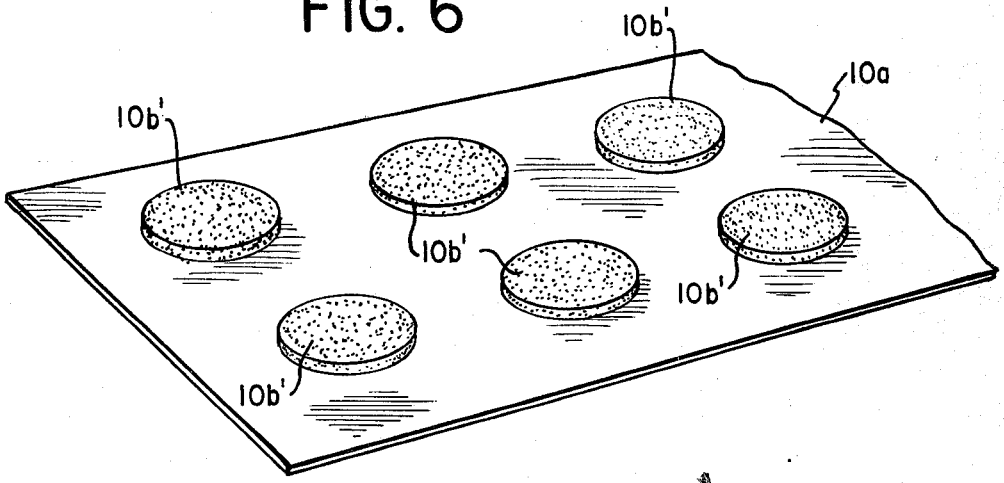
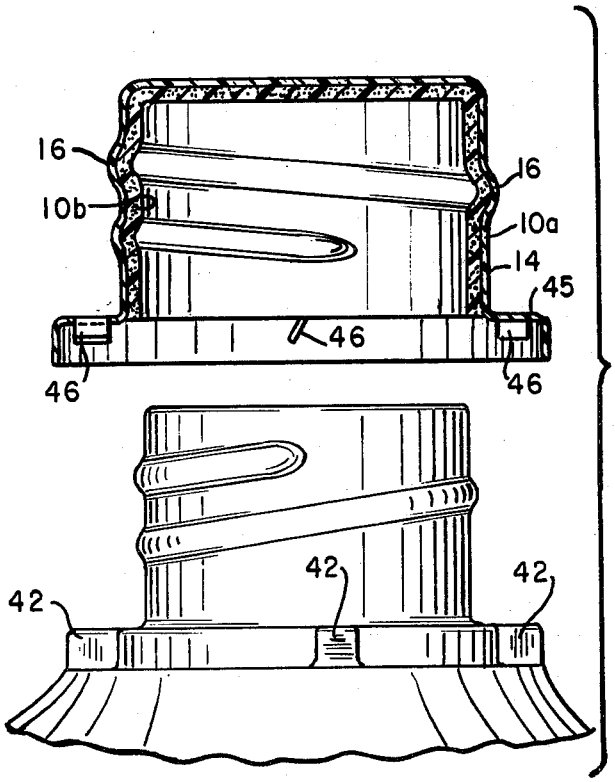
FIG. 7

THERMOFORMED CLOSURE OF COMPOSITE MATERIAL

BACKGROUND OF THE INVENTION

In prior U.S. Pat. No. 3,866,845, which is assigned to the assignee of the subject application, a thermoformed closure for a container is disclosed in which the closure material is of two sheets of material which are bonded together. In a preferred embodiment of the invention, one of the sheets of material is a relatively hard plastic, for example polystyrene, polyethylene, etc., while the other sheet is of a softer material, for example of a rubber-like plastic material such as that sold under the trademark KRATON. In the closure of that patent, the two sheets of material are bonded together, for example by laminating, before the laminate is placed in a thermoforming mold. The thermoforming operation is carried out in a manner such that the sheet of softer material is on the inside when the closure is formed. The purpose of the closure of the aforesaid patent is to eliminate the need for a separate liner, which is usually glued or force fit into the closure, and also to eliminate the separate lining operation.

The thermoplastic rubber material used for the preferred embodiment of closure disclosed in the prior United States patent, although effective in providing a seal, had certain disadvantages. One disadvantage of the thermoplastic rubber material is its relatively high cost. Of course, less expensive plastic materials which are softer could be used. Another disadvantage was the high coefficient of friction associated with a thermoplastic rubber material. This causes some difficulty in tightening the closure onto the container. This can be overcome by special treatment of the liner material to reduce the coefficient of friction.

The present invention relates to an improved closure of the foregoing type in which a composite of two materials is used for a thermoformed closure. The composite includes an outer layer, or skin, to which is bonded an inner layer used for the closure liner. The two materials of the composite are plastic and can be from the same family of materials or from different families.

In the preferred embodiment of the invention, a plastic material is used which has an outer layer which is relatively hard. To this is bonded an inner layer of a cellular expanded foam plastic of either the same or different material than the outer layer. Since the cellular expanded foam plastic material has a low coefficient of friction, less torque is required to tighten the closure than was required in the previous invention. Furthermore, since the expanded foam is somewhat compressible, the inner liner conforms to the shape of the threads and to the shape of the sealing lip of the container, thereby creating a tight seal.

Another aspect of the invention is the use of a composite plastic material of a cellular foam material with an integral skin. Here, the integral skin forms the outer shell material, thus obviating the need to bond separate sheets of plastic material together to form a laminate. That is, the composite skin and foam are formed from a single sheet of material, for example, by expanding a part of the sheet material into the foam.

It is therefore an object of the present invention to provide a novel closure thermoformed of a composite of materials, one of which is an expanded plastic foam.

A further object is to provide a thermoformed closure made from a composite of materials, one of which is an expanded cellular plastic foam, in which the foam serves as a liner.

Another object is to provide a thermoformed closure using an expanded plastic foam material with an integral outer skin.

Other objects and advantages of the present invention will become more apparent from the following specification and annexed drawings in which:

FIG. 6 is a perspective view of the composite used to make the closure of FIG. 5;

FIG. 7 is an exploded view with a closure in cross-section which shows a further embodiment of the invention with a tamper-proof feature and FIG. 8 is a view of a modification of the closure of FIG. 7.

DETAILED DESCRIPTION

Figure 1:
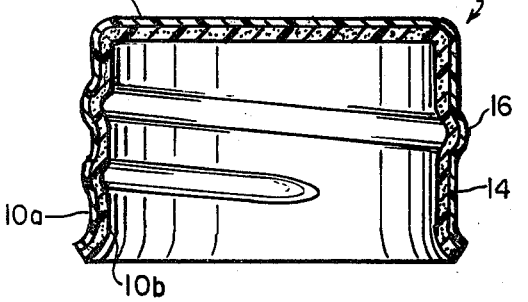
FIG. 1 is an elevation in cross-section of a preferred embodiment of the invention.

FIG. 1 shows a thermoformed closure 11 made in accordance with the invention. The closure includes the usual top wall 12, from which depends a skirt wall 14 having the usual threads 16 or other suitable fastening means thereon. The closure is thermoformed from a composite of plastic materials, as described below, suitable for thermoforming. That is, the plastic materials are of the thermoplastic type which can be shaped by heat in suitable male and/or female molds. The composite of material from which the closure is thermoformed has a relatively hard outer shell or skin and a relatively soft and deformable inner portion used for the liner.

Figure 2:
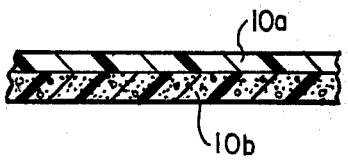
FIG. 2 is an elevation in cross-section of one type of material used for the closure.

In the closure 11 of the present invention, a sheet of cellular expanded foam thermoplastic material **10*b* is bonded to a sheet of harder thermoplastic material 10*a* to form a laminate, or composite, of material as shown in FIG. 2. As is described below, the foam plastic of sheet 10*b* of this laminate becomes the inner lining of the closure, while the harder thermoplastic material of sheet 10*a* becomes the outer shell. The invention is described with respect to sheets of the composite since these are more effective and economical to use in a multi-cavity thermoforming operation in which a number of closures can be formed at the same time. In addition, the use of sheet material permits the liner material 10*b* to be coextensive with the entire outer shell 10*a***.

In the preferred embodiment shown in FIG. 1, the inner material of sheet **10*b* is made of expanded styrene foam, for example 30 mil thick, and the material of sheet 10*a* for the outer shell is made of impact type styrene, for example 20 mil thick. The thicknesses for the various sheets are selected depending upon the use to which the closure to be put. For example, the material for the outer shell can be made thicker than the foam material for the liner to make the closure more rugged. The thicknesses of the materials, and particularly the outer shell 10*a*, can be selected so that the closure skirt wall 14** will be relatively stiff or flexible depending upon the particular application for which the closure is to be used.

Other thermoplastic materials which are suitable for the outer shell component of the laminate include polystyrene, polyethylene, polypropylene, ABS, and Acrilonitriles, such as are sold under the trade names LOPAC and BAREX, and LEXAN. Examples of additive materials suitable for the inner lining are polyethylene foam and ABS foam. The thermoplastic materials, including the foam materials, are conventional.

Figure 3:
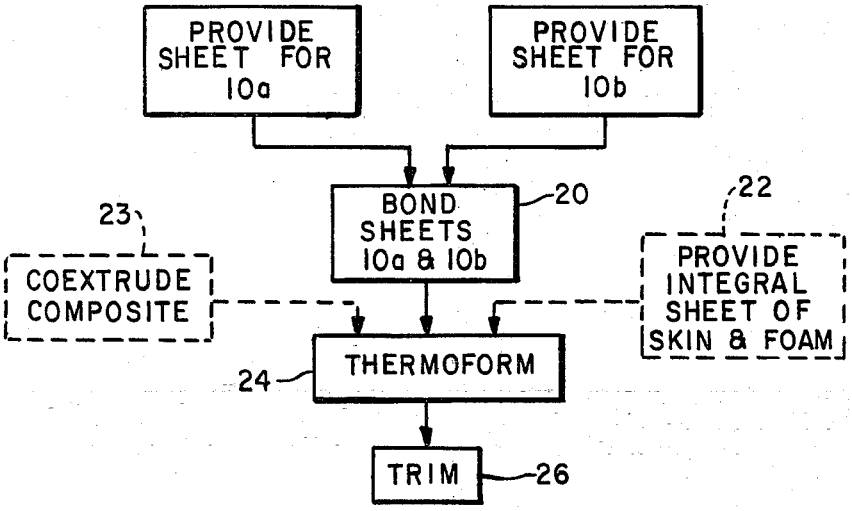
FIG. 3 is a flow diagram showing a method of making the closure together with an alternative using a different material.

FIG. 3 is a flow diagram showing the process of making the closures. Sheets of material 10*a* and 10*b* are provided. The outer material 10*a* is bonded, or laminated to the material 10*b* as represented by block 20. The bonding can be achieved in different ways, depending primarily on the specific compositions used for the liner material 10*b* and the outer material 10*a*. For example, the sheets can be bonded by suitable adhesives, or by laminating under heat and/or pressure. After the liner material 10*b* and the outer material 10*a* are bonded together, they are then formed into the desired closure configuration as represented by block 24. This can be accomplished by any suitable conventional thermoforming processes and machines. It is preferred that a multi-cavity machine be used for economy. As in the prior U.S. Pat. No. 3,866,845 to Keeler et al, the particular thermoforming process and machinery used is not part of the present invention. The final step in making the closure of the invention is trimming the excess material from the closure as represented by block 26 in FIG. 3. After trimming, the closures are placed on the containers where they are to be used by conventional capping equipment.

It will be appreciated that the bonding of the laminate as represented by block 20 may actually be simultaneous with the forming of the closure, although these processes are depicted as separate steps in FIG. 3. That is, separate sheets 10*a* and 10*b* are placed in the thermoforming machine. The liner material 10*b* is bonded to the skin 10*a* of the closure by the heat of the thermoforming process as the closures are being formed.

In the preferred embodiment of the invention shown in FIG. 1, the closure has a continuous thread 16 to fit corresponding threads on the container neck. It should be understood that the closure can have other means of securing it to the container, such as multiple-start threads or bayonet threads.

A further embodiment of the invention is made according to the alternative path shown in FIG. 3. In this embodiment, an expanded foam with an integral skin is used as represented by dotted line block 22. This material, an example of which could be a polystyrene foam with an integral skin, incorporates both the outer shell component and the inner liner component. In this embodiment, the step 20 in the process of bonding the two sheets of material together is eliminated. That is, the foam is formed directly as a part of the original sheet of plastic material. The composite also can be coextruded, as shown by dotted line block 23.

Figure 4:
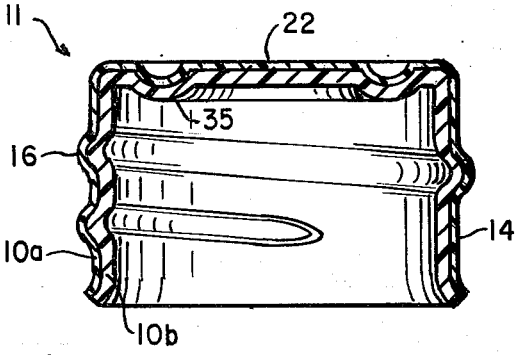
FIGS. 4 and 5 show further embodiments of the invention.

The closure of FIG. 1 is shown formed with a substantially flat top 12. Other closures are shown in FIG. 4, where the top wall 22 has a recessed ring 35. The ring 35 extends downwardly from the top wall and can be located so as to seal either the inner or outer edge of the bottle lip. While the recess is shown as being generally semi-circular, other shapes can be used, for example, triangular, rectangular, U-shaped, etc.

Figure 5:
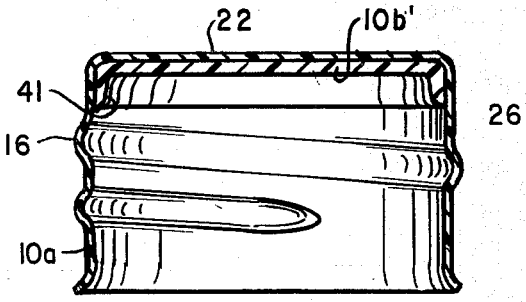

Another embodiment of closure is shown in FIG. 5, where the inner liner material 10*b*′ covers the inside of the top wall 22 and descends only a small distance down its skirt wall 26, as is indicated by numeral 41. An advantage of this embodiment over that shown in FIG. 1, where the liner material 10*b* is coextensive with extent of the skirt wall 14, is the saving of material. A disadvantage lies in the difference in making the laminate of the two materials and in properly registering the laminate with respect to the thermoforming machine.

The closures shown in FIG. 5 are made from a laminate sheet shown in FIG. 6, where circles of inner liner material 10*b*′ are bonded to a sheet of outer shell material 10*a*, spaced at appropriate intervals, so that the circles will be generally centered in the closures when the sheet is thermoformed. Annular rings also can be used with the rings located to be in the top wall of the closure so that they will cover the lip of the container when applied thereto.

Figure 8:
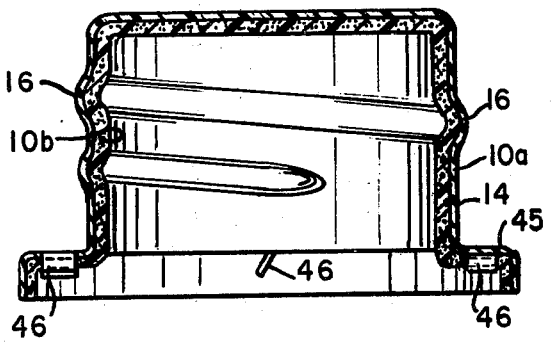

Tamper proof tabs can be used on the closure. One such arrangement is shown in FIG. 7. Here, the neck of container 40 is provided with one or more projections 42 around its periphery. The closure has a shoulder 45 extending outwardly from its skirt wall. One or more downwardly extending tabs 46 are found on shoulder 45. The tabs 46 can be formed by lancing, cutting or piercing the shoulder after the closure is thermoformed. Tabs 46 are angled from the vertical so that when the closure is threaded (turned clockwise as shown) onto the container neck they will ride over the projections 42. As the closure is rotated to unthread it, the ends of the tab or tabs 46 engage a container projection 42 and break off giving a tamper proof indication. If only the foam material 10*b* were present, the tab would not break off since the foam tab would "roll up" as it engaged a projection. The shell material 10*a* is somewhat stiff and is strong enough to withstand the engagement with a projection and break off as the closure is rotated. In FIG. 7, the tabs 46 are cut in an area of the closure wall where there is no liner material. In FIG. 8, the liner material covers the entire skirt wall including the area where the tabs 46 are cut.

What is claimed is:

1. A container closure comprising a thermoformed unitary composite material structure having an outer shell of thermoformed thermoplastic material of substantially uniform thickness throughout except in the areas where deformed during thermoforming and having a top wall and a skirt wall depending therefrom, and a liner of compressible cellular foam thermoplastic material located within and being coextensive with the entire inner surface of said outer shell, said liner being of substantially uniform thickness throughout except in the areas where deformed during thermoforming and bonded to the inner surface of said shell and formed to the desired shape during the thermoforming of the closure, and at least one tab cut through the shell and liner of said closure skirt wall and extending inwardly therefrom, said tab adapted for engaging a member on the container as the closure is unfastened therefrom.

2. A container closure comprising a thermoformed unitary composite material structure having an outer shell of thermoformed thermoplastic material of substantially uniform thickness throughout except in the areas where deformed during thermoforming and having a top wall and a skirt wall depending therefrom, and a liner of compressible cellular foam thermoplastic material located within said outer shell, said liner being of substantially uniform thickness throughout except in the areas where deformed during thermoforming and bonded to the inner surface of said shell and formed to the desired shape during the thermoforming of the closure over said top wall and at least a portion of the skirt wall, and an outwardly extending portion formed on the bottom of said skirt wall and at least one tab partially cut in said outwardly extending portion of the skirt wall and extending downwardly.

3. A container closure comprising a thermoformed unitary composite material structure having an outer shell of thermoformed thermoplastic material of substantially uniform thickness throughout except in the areas where deformed during thermoforming and having a top wall and a skirt wall depending therefrom, and a liner of compressible cellular foam thermoplastic material located within said outer shell, said liner being of substantially uniform thickness throughout except in the areas where deformed during thermoforming and bonded to the inner surface of said shell and formed to the desired shape during the thermoforming of the closure over said top wall and a portion of the skirt wall, said liner material as formed only partly covering the interior of the skirt wall of the shell, and at least one tab cut through the skirt wall in the area without the liner and extending inwardly therefrom, said tab adapted for engaging a member on the container as the closure is unfastened therefrom.

* * * * *